US005729923A

United States Patent [19]

Lin

[11] Patent Number: 5,729,923

[45] Date of Patent: Mar. 24, 1998

[54] CRYSTAL WATER BALL DEVICE

[76] Inventor: Chung-kuei Lin, 6F-4, No. 1, Wuchuan 1st Rd., Wuku Industrial Dist., Hsinchuang City, Taipei Hsien, Taiwan

[21] Appl. No.: 789,554

[22] Filed: Jan. 27, 1997

[51] Int. Cl.[6] ..... G09F 19/00

[52] U.S. Cl. ..... 40/409; 40/410; 446/267

[58] Field of Search ..... 40/409, 410; 446/267

[56] References Cited

U.S. PATENT DOCUMENTS 5,110,636 5/1992 Hou ..... 40/410 X 5,555,656 9/1996 Liu ..... 40/410 X

*Primary Examiner*—Kenneth J. Dorner

*Assistant Examiner*—Andrea Chop

*Attorney, Agent, or Firm*—Kolisch, Hartwell, Dickinson, McCormack & Hartwell

[57] ABSTRACT

A crystal water ball mechanism employed to simultaneously turn a lower, outer decoration and an upper, inner decoration and a crystal water ball device incorporating such a mechanism. The lower and upper decorations are respectively affixed to an outer ring which is driven to turn by a first driving element via a coupling ring and affixed to a rotating plate which is driven to turn by a second driving element via a connecting member of the device.

4 Claims, 6 Drawing Sheets

CRYSTAL WATER BALL DEVICE

BACKGROUND OF THE INVENTION

The present invention relates to decorative articles and more particularly to a crystal water ball mechanism, or a decorative, e.g. snowstorm-effect, domed device, which may be employed to produce multi-functional entertainment.

Prior crystal water balls or similar articles can only have either their inner or upper decoration or their outer or lower decoration, but not both inner and outer decorations, rotate.

A crystal water ball device capable of simultaneous rotation of inner and outer decorations is disclosed in same Applicant's another patent application Ser. No. 08/715,400, filed on Sep. 18, 1996, currently pending. The present application discloses a crystal water ball device of a different structure.

BRIEF SUMMARY OF THE INVENTION

A primary object of the present invention is to provide a crystal water ball mechanism which achieves a simultaneous rotation of a first driving element and a second driving element which then can be utilized to drive inner and outer decorations of a crystal water ball device.

In accordance with a feature of the invention, the crystal water ball mechanism comprises: a base; a musical unit fixedly supported on the base; a lower assembly rotatably supported on the base; a driving assembly mounted in a fixed relationship with respect to the musical unit and comprising a first driving element and a second driving element, the first driving element being in mesh with the musical unit and the second driving element being indirectly driven to turn by the first driving element; and a coupling ring being coupled between the first driving element and the lower assembly for transferring a turning movement of the first driving element to the lower assembly, thereby turning the lower assembly over the base.

In accordance with another feature of the present invention, in the above-mentioned crystal water ball mechanism, the base comprises an annular rail on an upper face thereof and the lower assembly comprises an outer ring having an annular recess in a bottom face thereof, a retaining ring having a plurality of equally spaced holes thereon, and a plurality of balls each disposed within a corresponding hole between the annular rail of the base and the annular recess of the outer ring.

In accordance with a further feature of the present invention, in the above-mentioned crystal water ball mechanism, a stop piece is further provided to be fixedly mounted to the base for confining an upward movement of the lower assembly.

In accordance with yet a further feature of the present invention, in the above-mentioned crystal water ball mechanism, the driving assembly comprises an upper cup. In this arrangement, a crystal water ball device is constructed by incorporating a water ball assembly mounted to an upper rim of the upper cup, wherein the the water ball assembly comprises: a ball; a floor member; a sealing member connected between the ball and the floor member and placed upon the upper rim of the upper cup; a rotating plate for carrying an inner decoration thereon; and a connecting member frictionally engaging the rotating plate to be rotatable together and rotatably engaged with the second driving element of the driving assembly.

Other objects and novel features of the invention will become more apparent from the following detailed description when taken in conjunction with the accompanying drawings.

DETAILED DESCRIPTION OF THE INVENTION

Figure 1:
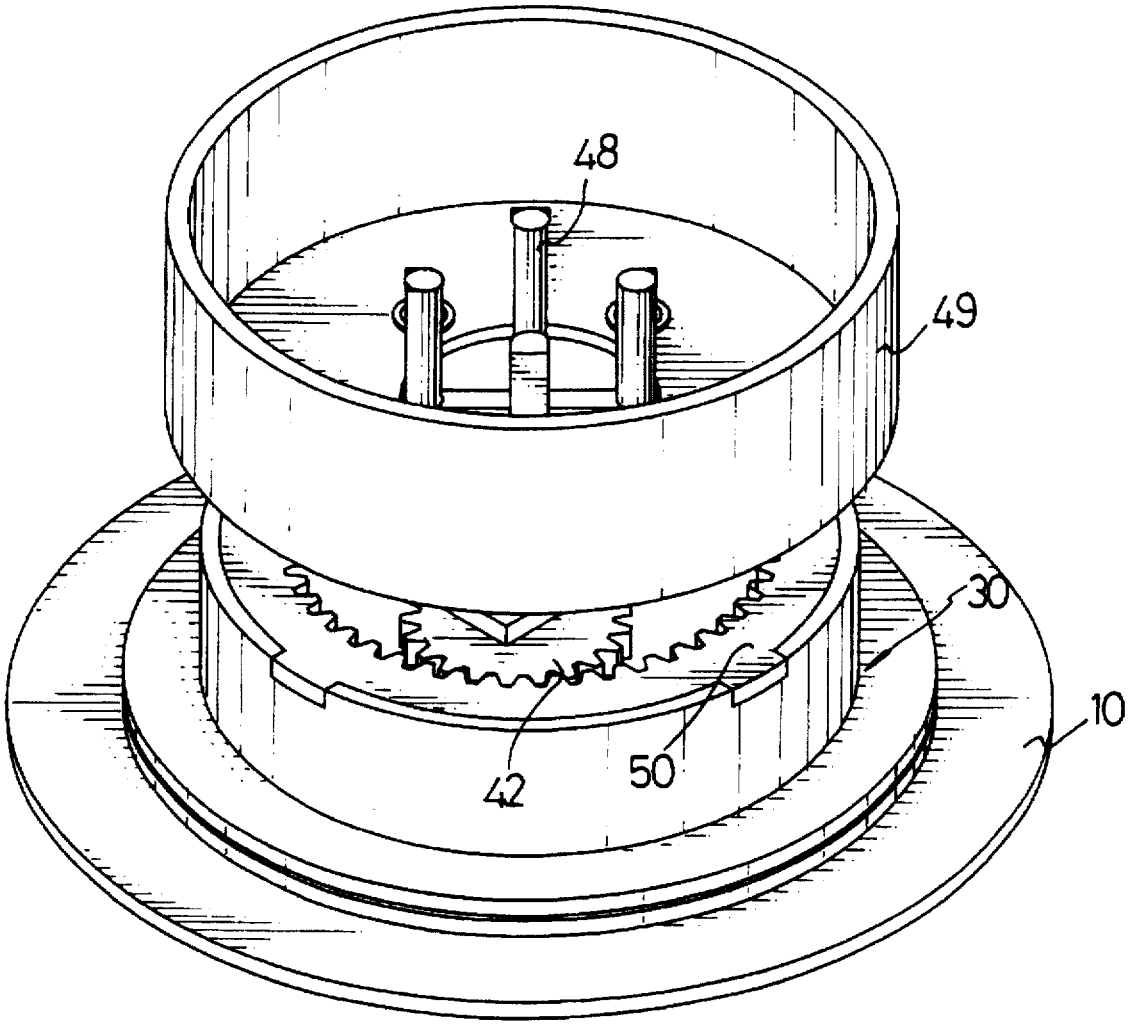
FIG. 1 is a perspective view showing a crystal water ball mechanism in accordance with the present invention.

FIG. 1 shows a crystal water ball mechanism of the invention which comprises a base 10, a musical unit 20 (shown in FIG. 2) to be fixedly supported on the base 10, a lower assembly 30 to be rotatably supported on the base 10, a driving assembly 40 (more clearly shown in FIG. 4) mounted in a fixed relationship with respect to the musical unit 20, and a coupling ring 50 coupled between the driving assembly 40 and the lower assembly 30.

Figure 4:
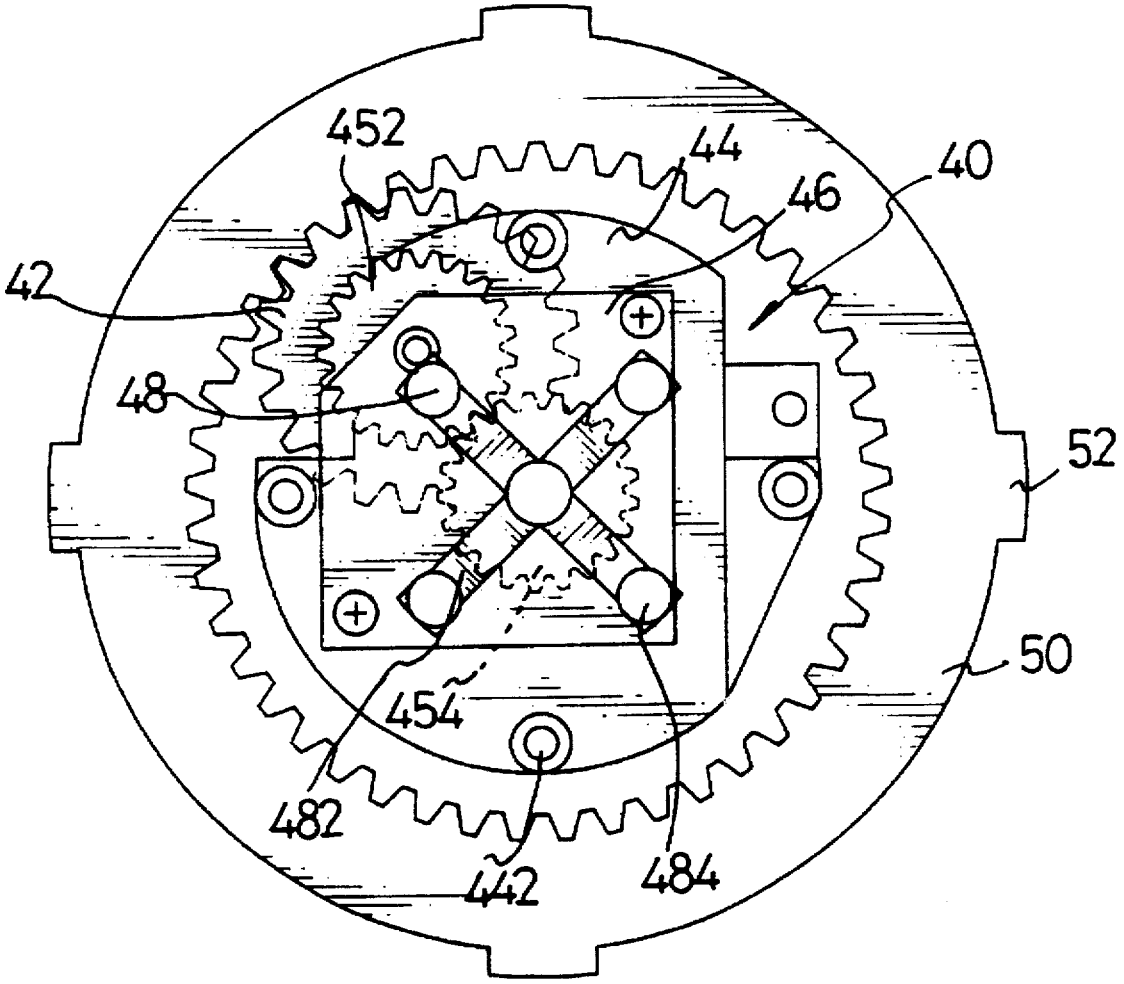
FIG. 4 is a plan view showing the interconnection between a driving assembly and a coupling ring of the crystal water ball mechanism of FIG. 1.

As clearly shown in FIG. 4, the driving assembly 40 comprises a first driving element 42 and a second driving element 48. The first driving element 42 in this embodiment is a compound gear consisted of a lower crown gear (not shown) in mesh with an output gear 21 (see FIG. 2) of the musical unit 20 and an integral upper spur gear. The second driving element 48 in this embodiment is a cruciform driver 482 with four upright legs 484 respectively attached at four ends thereof. The driving assembly 40 further comprises a main body 44 which is to be fixedly mounted to the musical unit 20 and a hood 46 which, when being mounted to the main body 44, defines a space for accommodating a first gear 452 and a second gear 454. The first and second gears 452 and 454 are journaled to the first driving element 42 and the second driving element 48, respectively, and are further in mesh with each other so that the second driving element 48 may be indirectly driven to turn by the first driving element 42 via the first and second gears 452 and 454.

Figure 2:
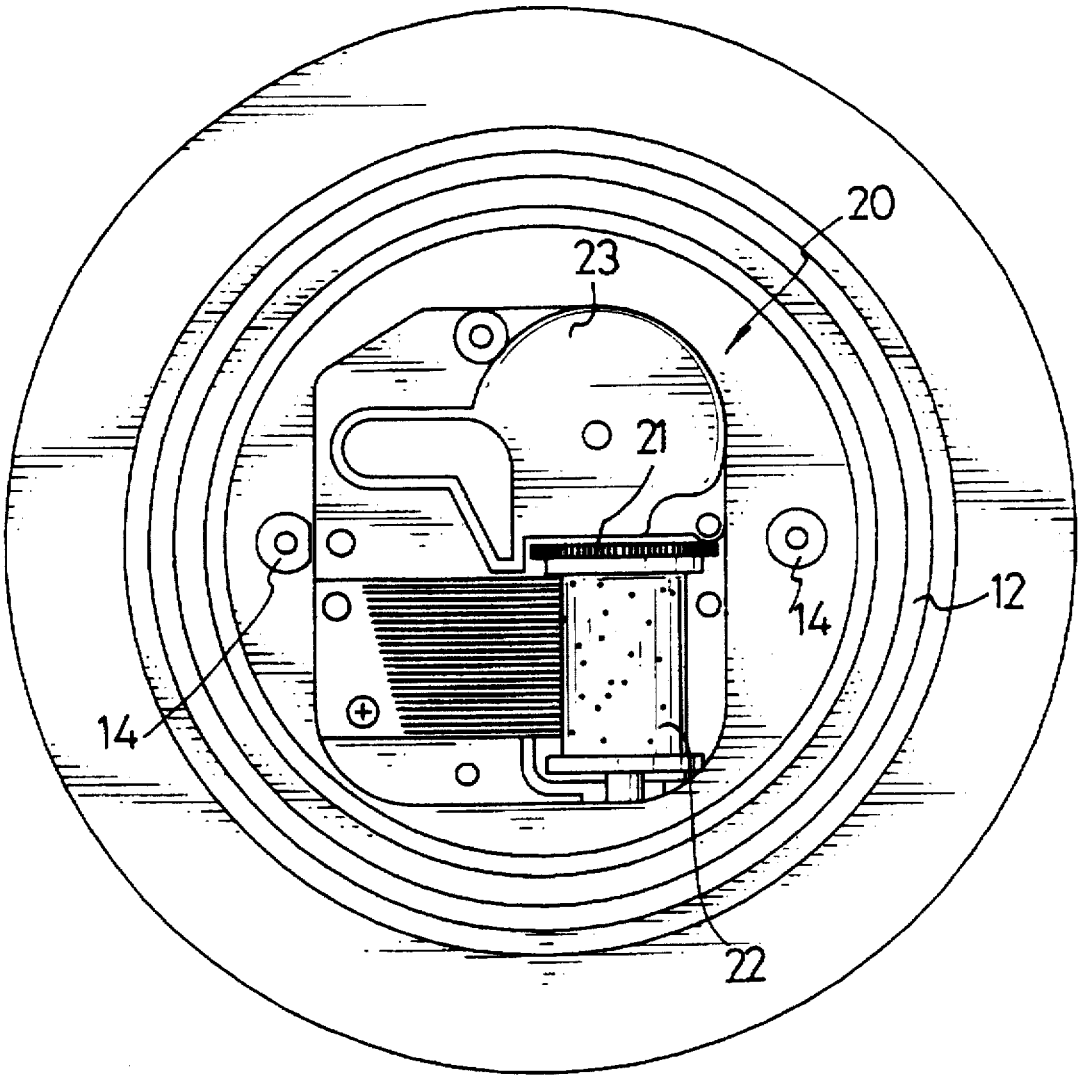
FIG. 2 is a plan view showing a musical unit received within a base of the crystal water ball mechanism of FIG. 1.

As previously mentioned, the musical unit 20 is fixedly supported on the base 10. The musical unit 20 is per se known and commercially available and its gear 21 is affixed to a pinned barrel 22. With the musical unit 20 mounted to the base 10, a knob (not shown) extends outward from a bottom of the base 10 for manipulating a driving mechanism 23, as shown in FIG. 2.

Figure 3:
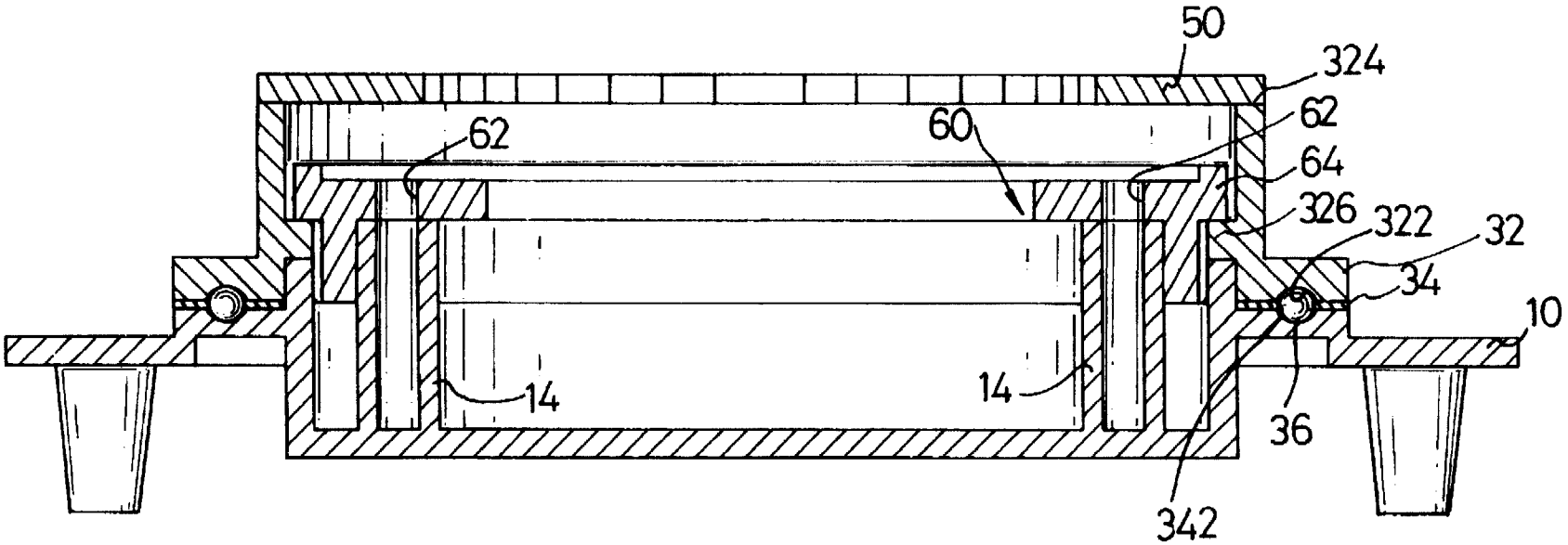
FIG. 3 is a cross-section, in an enlarged scale, showing the interconnection between a base, a lower assembly and a stop piece of the crystal water ball mechanism of FIG. 1.

Referring to FIG. 3, the base 10 comprises an annular rail 12 on an upper face thereof. The lower assembly 30 comprises an outer ring 32 having an annular recess 322 on a bottom face thereof, a retaining ring 34 having a plurality of equally spaced holes 342 defined therein, and a plurality of balls 36 each disposed within a corresponding hole 342 between the annular rail 12 of the base 10 and the annular recess 322 of the outer ring 32. The outer ring 32 has a number of notches 324 matingly receiving protrusions 52 of the coupling ring 50 so that the outer ring 32 and the coupling can rotate together. Referring also to FIG. 4, the coupling ring 50 coupled between the upper spur gear of the first driving element 42 and the outer ring 32 of the lower assembly 30 therefore can transfer a turning movement of the first driving element 42 to the lower assembly 30, thereby turning the lower assembly 30 over the base 10.

FIG. 3 further shows that a stop piece 60 is disposed between the base 10 and the outer ring 32 of the lower assembly 30. In particular, the stop piece 60 has a pair of holes 62 defined therein and aligned with a corresponding pair of posts 14 on the base 10 so that the stop piece 60 can be fixed to the base 10 by suitable fasteners (not shown). The stop piece 60 has an outer flange 64 with a lower face at a position over an annular ridge 326 of the outer ring 32 so that an upward movement of the outer ring 32 is prevented. This ensures a proper engagement or turning movement of the lower assembly 30 with or over the base 10.

Figure 5:
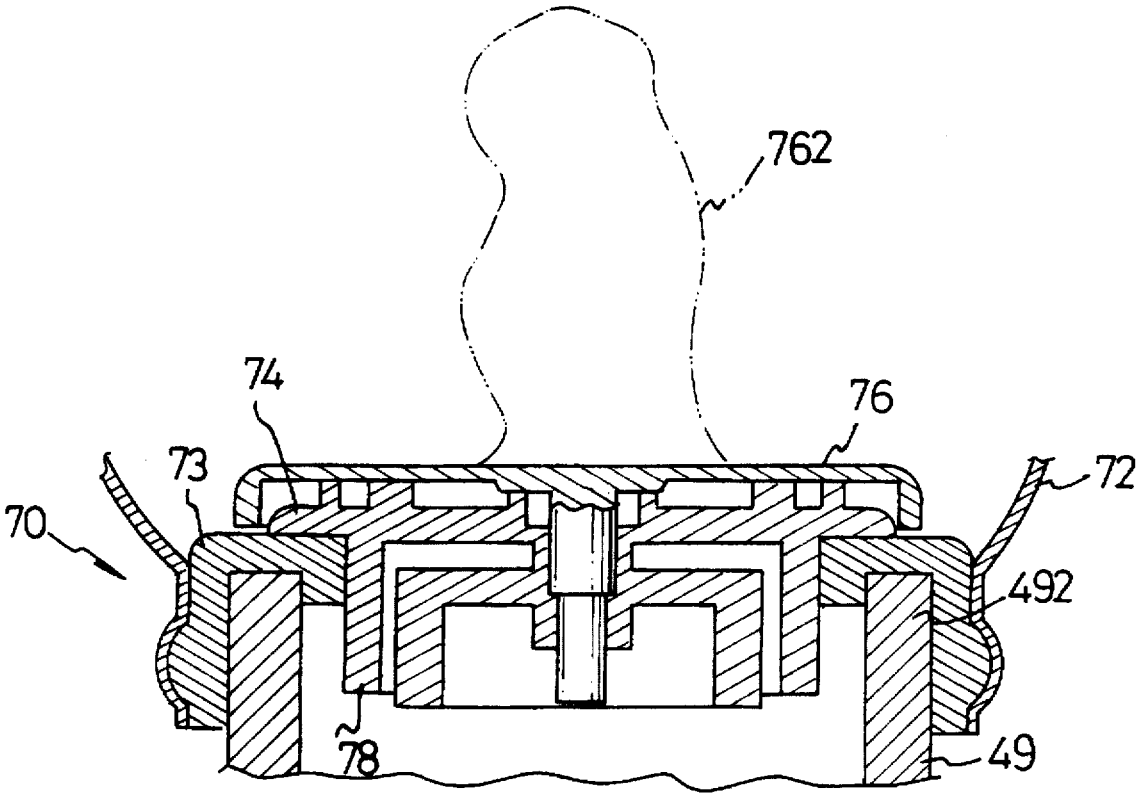
FIG. 5 is a cross-section of a water ball assembly employed in the present invention.

FIG. 1 also shows that an upper cup 49 is fixedly mounted to the main body 44 of the driving assembly 40. In FIG. 5, it can be seen that a water ball assembly 70 is mounted to an upper rim 492 of the upper cup 49. With this arrangement, a crystal water ball device incorporating the above-described crystal water ball mechanism and the water ball assembly 70 is constructed. The water ball assembly 70 comprises a glass ball 72, a floor member 74, a sealing member 73 sealingly connected between the ball 72 and the floor member 74 and placed upon the upper rim 492 of the upper cup 49, a rotating plate 76 for carrying an inner decoration 762 thereon, and a connecting member 78 frictionally engaging the rotating plate 76 to be rotatable together and rotatably engaged with the second driving element 48 of the driving assembly 40. The frictional engagement between the connecting member 78 and the rotating plate 76 can be made by any known means, such as a pin and hole connection.

Figure 6:
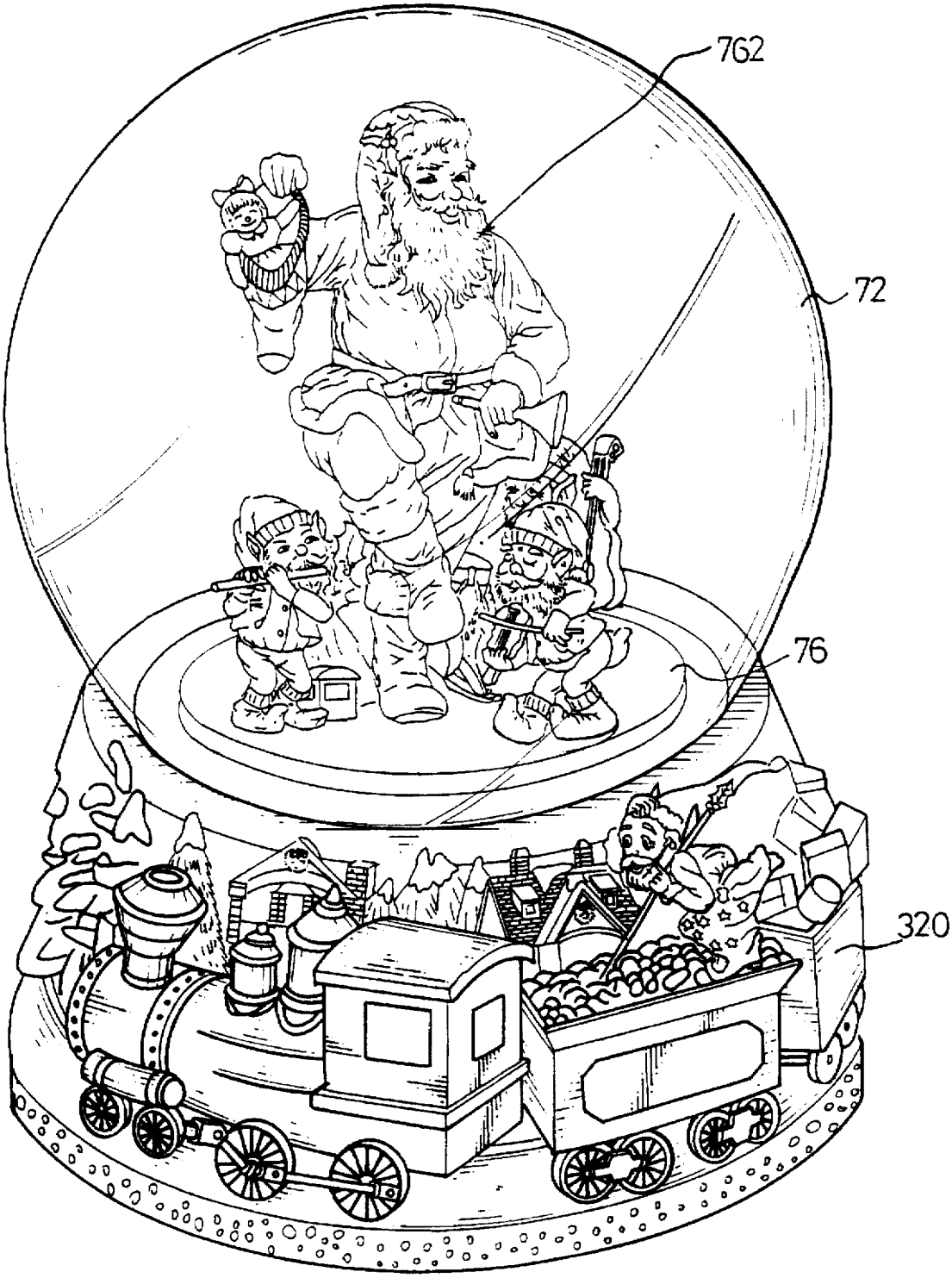
FIG. 6 exemplarily shows a crystal water ball device with upper and lower decorations.

FIG. 6 exemplarily shows a crystal water ball device with upper (inner) and lower (outer) decorations. As previously mentioned, the upper, inner decoration 762 is placed on or affixed to the rotating plate 76, while the lower, outer decoration 320 is affixed to the outer ring 32. In operation, both the upper and lower decorations 762 and 320 will be turned, in opposite direction, to produce an appealing entertainment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A crystal water ball mechanism comprising a base having an annular rail on an upper face thereof;

a musical unit fixedly supported on the base;

a lower assembly comprising an outer ring having an annular recess in a bottom face thereof, a retaining ring having a plurality of equally spaced holes therein, and a plurality of balls each disposed within a corresponding hole between the annular rail of the base and the annual recess of the outer ring;

a driving assembly mounted in a fixed relationship with respect to the musical unit and comprising a first driving element and a second driving element, the first driving element being in mesh with the musical unit and the second driving element being indirectly driven to turn by the first driving element; and a coupling ring being coupled between the first driving element and the lower assembly for transferring a turning movement of the first driving element to the lower assembly, thereby turning the lower assembly over the base.

2. The mechanism as claimed in claim 1, further comprising a stop piece fixedly mounted to the base for confining an upward movement of the lower assembly.

3. The mechanism as claimed in claim 1, wherein the driving assembly comprises an upper cup.

4. A crystal water ball device comprising the mechanism as claimed in claim 3 and a water ball assembly mounted to an upper rim of the upper cup, the water ball assembly comprising:

a ball, a floor member, a sealing member connected between the ball and the floor member and placed upon the upper rim of the upper cup, a rotating plate for carrying an inner decoration thereon, and a connecting member frictionally engaging the rotating plate to be rotatable together and rotatably engaged with the second driving element of the driving assembly.

* * * * *